United States Patent [19]

Beasley

[11] Patent Number: 4,988,094

[45] Date of Patent: Jan. 29, 1991

[54] AQUATIC EXERCISE APPARATUS

[76] Inventor: Bob L. Beasley, 1217 Terra Mar Dr., Tampa, Fla. 33613

[21] Appl. No.: 241,046

[22] Filed: Sep. 6, 1988

[51] Int. Cl.[5] ..... A63B 21/00

[52] U.S. Cl. ..... 272/116; 272/71

[58] Field of Search ..... 272/116, 130, 71, 93, 272/71, 116; 424/254; 441/55, 56, 58, 61

[56] References Cited

U.S. PATENT DOCUMENTS

| | | | |
|---|---|---|---|
| 3,203,694 | 8/1965 | Kobashikawa . | |
| 3,621,500 | 11/1971 | Senghas . | |
| 3,734,493 | 5/1973 | Hasekian | 272/122 |
| 4,458,896 | 7/1984 | Solloway | 272/116 |
| 4,623,142 | 11/1986 | MacKechnie | 272/116 |
| 4,632,387 | 12/1986 | Guzman | 272/116 |
| 4,819,951 | 4/1989 | Solloway | 272/116 |

FOREIGN PATENT DOCUMENTS

| | | | |
|---|---|---|---|
| 0931201 | 6/1982 | U.S.S.R. | 272/71 |

*Primary Examiner*—Randall L. Green
*Assistant Examiner*—David H. Willse
*Attorney, Agent, or Firm*—Frijouf, Rust & Pyle

[57] ABSTRACT

This invention concerns an aquatic exercise apparatus which is used by an exerciser in a body of water. The apparatus comprises a handgrip for gripping the apparatus by the hand of the exerciser with the handgrip having a first end and a second end. A first and a second fluid resistance member is secured at the first end and the second end of the handgrip, respectively, such that in use when the handgrip is gripped by the hand of the exerciser and moved by the arm of the exerciser in a first plane in which the resistance to such movement is increased. A third fluid resistance member is secured to the handgrip in a plane parallel to the handgrip to form an opening defined by the third fluid resistance members and the handgrip for receiving in use a portion of the hand of the exerciser such that in use when the handgrip is gripped by the hand of the exerciser and moved by the arm of the exerciser in a plane perpendicular to the first plane resistance to such movement is increased. A foot attachment means is secured to the third fluid resistance member for detachably securing the apparatus to a foot of the exerciser such that movement of the apparatus by the leg of the exerciser in a plane perpendicular to the plane which includes the handgripping means resistance to such movement is increased by the third fluid resistance means and movement of the apparatus by the leg of the exerciser in the plane which includes the handgripping means is resisted by the first and the second fluid resistance means such that resistance to such movement is increased.

11 Claims, 3 Drawing Sheets

AQUATIC EXERCISE APPARATUS

BACKGROUND OF THE INVENTION

1. Related Application

This application is related to co-pending application ser. no. 839,038 filed Mar. 12, 1986, now U.S. Pat. No. 4,768,774, which is incorporated herein by reference as if fully set forth herein.

2. Field of the Invention

This invention relates to an aquatic apparatus for exercising in a body of water and more particularly for exercising either the arm or the leg of the exerciser in a body of water.

3. Information disclosure statement

Numerous aquatic devices which increase resistive forces for strengthening particular muscles or muscle groups are known. Other aquatic devices are swimming aids which enhance swimming abilities by increasing the area of resistance against the water to increase the speed of the swimmer.

What is needed is a foot engagable and hand engagable aquatic exercise apparatus which may be easily interchangeably secured to either the foot or hand of an exerciser while providing benefits to the exerciser in either the foot position or hand position which are not otherwise attainable.

Therefore, it is an object of this invention to provide a single aquatic exercise apparatus which may be easily interchangeably secured to either the hand or the foot of an exerciser.

It is a further object of this invention to provide an aquatic exercise apparatus which when used in pairs enables arm-arm, arm-leg or leg-leg exercise without changing to another apparatus.

It is a further object of this invention to provide an aquatic exercise apparatus which is not dedicated to either limb of the exerciser.

It is a further object of this invention to provide an aquatic exercise apparatus which is easily removably attachable to either the hand or to the foot to enable exercise of either the arm or the leg, respectively.

It is a further object of this invention to provide an aquatic exercise apparatus which when securably attached to the foot of the exerciser aids in decreasing lateral movement of the leg of the exerciser thereby lessening the twisting action of the knee associated with the exercise of the leg in a body of water.

It is a further object of this invention to provide an aquatic exercise apparatus which includes a third fluid resistance means such as a flat plate member with a resilient pad properly positioned on the interior surface of the flat plate member and properly positioned from the handgripping means such that the hand of the exerciser is frictionally engaged between the resilient pad and handgripping means such that the securement of the apparatus to the hand of the exerciser is enhanced.

It is a further object of this invention to provide an aquatic exercise apparatus which provides multidimensional resistance through all planes of movement by the arm of the exerciser.

It is a further object of this invention to provide an aquatic exercise apparatus which provides a third fluid resistance means which also functions in use as a foot support surface when the apparatus is secured to the foot of the exerciser.

It is a further object of this invention to provide an aquatic exercise apparatus which utilizes cup-shaped members which aid in stabilizing the apparatus as it is moved through the body of water in a predetermined direction selected by the exerciser.

It is an advantage of this invention to enable exercise of either the arm or the leg and then exercise the limb not exercised without having to change the exercising apparatus.

It is a further advantage of this invention to enable exercise of either the arm or the leg to a predetermined point of fatigue and then exercise the limb not exercised without having to change the exercising apparatus.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The aquatic exercise apparatus of the present invention is defined by the appended claims with a specific embodiment shown in the attached drawings. For the purpose of summarizing the invention, the invention relates to an aquatic exercise apparatus for use by an exerciser in a body of water, wherein the apparatus comprises a handgripping means for gripping the apparatus by the hand of the exerciser. The handgripping means includes a longitudinal dimension extending between a first end and a second end. A first and a second fluid resistance means is secured at the first end and the second end of the handgripping means, respectively. Thus, when the handgripping means is gripped by the hand of the exerciser the first and second fluid resistance means increase resistance to movement by the arm of the exerciser in a first plane which includes the longitudinal dimension of the handgripping means. A third fluid resistance means is secured to the handgripping means in a plane parallel to the longidutinal dimension of the handgripping means to form an opening defined by the third fluid resistance means and the handgripping means. The opening receives a portion of the hand of the exerciser. Thus, when the handgripping means is gripped by the hand of the exerciser and the apparatus is moved by the arm of the exerciser in a second plane perpendicular to the first plane, resistance to such movement by the arm is increased. A foot attachment means is secured to the third fluid resistance means for detachably securing the apparatus to a foot of the exerciser.

The foot attachment means of the apparatus enables the third fluid resistance means to increase resistance to movement of the apparatus by the leg of the exerciser in the second plane. The foot attachment means of the apparatus also enables the first and the second fluid resistance means to increase resistance to movement of the apparatus by the leg of the exerciser in the first plane. Having the first and the second fluid resistance means positioned in a plane perpendicular to the third fluid resistance means decreases lateral movement of the leg of the exerciser when the apparatus is securably attached to the foot of the exerciser. Decreasing lateral movement of the leg lessens any twisting action to the knee of the exerciser. Such twisting may be injurious to weakened knees.

In the preferred embodiment, the handgripping means is a shank-type handgrip.

Preferably, the first and the second fluid resistance means which are secured at the first end and the second end of the handgripping means, respectively, each define a cup-shaped member having a closed end and an open end. The cup-shaped member does not allow fluid flow through the cup-shaped member by securing each cup-shaped member to the handgripping means at the closed end with the open end or concave surface facing outwardly from the handgripping means.

The third fluid resistance means provides increased resistance to movement of the arm of the exerciser when the handgripping means is gripped by the hand of the exerciser and the apparatus is moved by the arm of the exerciser in a plane perpendicular to the plane parallel to the handgripping means. The third fluid resistance means is a flat plate member which extends in the plane parallel to the handgripping means. For enhanced securement of the apparatus to the hand of the exerciser the flat plate member preferably includes a resilient pad to frictionally engage the hand of the exerciser. The resilient pad may be made of foam rubber and the like. Preferably, the flat plate member further includes a plurality of apertures extending through it to permit the fluid to flow through the flat plate member thereby aiding in the control of the apparatus when moved by the exerciser in the plane perpendicular to the handgripping means.

For increased versatility, the aquatic exercise apparatus further includes a foot attachment means. Preferably, the foot attachment means secured to the third fluid resistance means for detachably securing the apparatus to a foot of the exerciser includes a strap member attached to the third fluid resistance means for securing the top of the foot of the exerciser to the apparatus and an ankle member attached to the third fluid resistance means for securing the ankle of the exerciser to the apparatus.

In a preferred embodiment the aquatic exercise apparatus comprises a handgripping means for gripping the apparatus by the hand of the exerciser with the handgripping means having a first end and a second end. A first and second fluid resistance means are secured at the first end and the second end of the handgripping means, respectively, with the first and second fluid resistance means each defining a cup-shaped member having a closed end. Thus, when the handgripping means is gripped by the hand of the exerciser and moved by the arm of the exerciser in a first plane resistance to such movement is increased. A third fluid resistance means is a flat plate member which is secured to the handgripping means in a plane parallel to the handgripping means. An opening is formed by the space between the flat plate member and the handgripping means. The opening receives a portion of the hand of the exerciser when the handgripping means of the apparatus is gripped by the hand of the exerciser and moved by the arm of the exerciser in a plane perpendicular to the first plane, resistance to such movement is increased.

A foot attachment means is secured to the flat plate member for detachably securing the apparatus to the foot of the exerciser such that in use upon movement of the first apparatus by the leg of the exerciser in a plane perpendicular to the first plane, resistance to such movement is increased by the flat plate member and movement of the apparatus by the leg of the exerciser in the plane which includes the handgripping means is resisted by the cup-shaped members such that resistance to such movement is increased. Preferably, the cup shaped members are attached to the handgripping means at the closed end with the open end extending outwardly. In an alternative embodiment, the cup-shaped members may be attached to the handgripping means at the closed end with the open end extending inwardly, toward the handgripping means. The foot attachment means includes a strap member for securing the top of the foot of the exerciser to the apparatus and an ankle member for securing the ankle of the exerciser to the apparatus. The cup-shaped members are resilient such that in use when the foot of the exerciser is inserted into a slot formed between the flat plate member and the foot strap member, the cup-shaped members resistantly engage the flat plate member to provide a gradually increasing resistance to a continued spacing apart of the strap member relative to the flat plate member thereby increasingly tensioning the strap member against the top of the foot of the exerciser. This engagement enhances the securement of the apparatus to the foot of the exerciser.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE DRAWINGS

Figure 1:
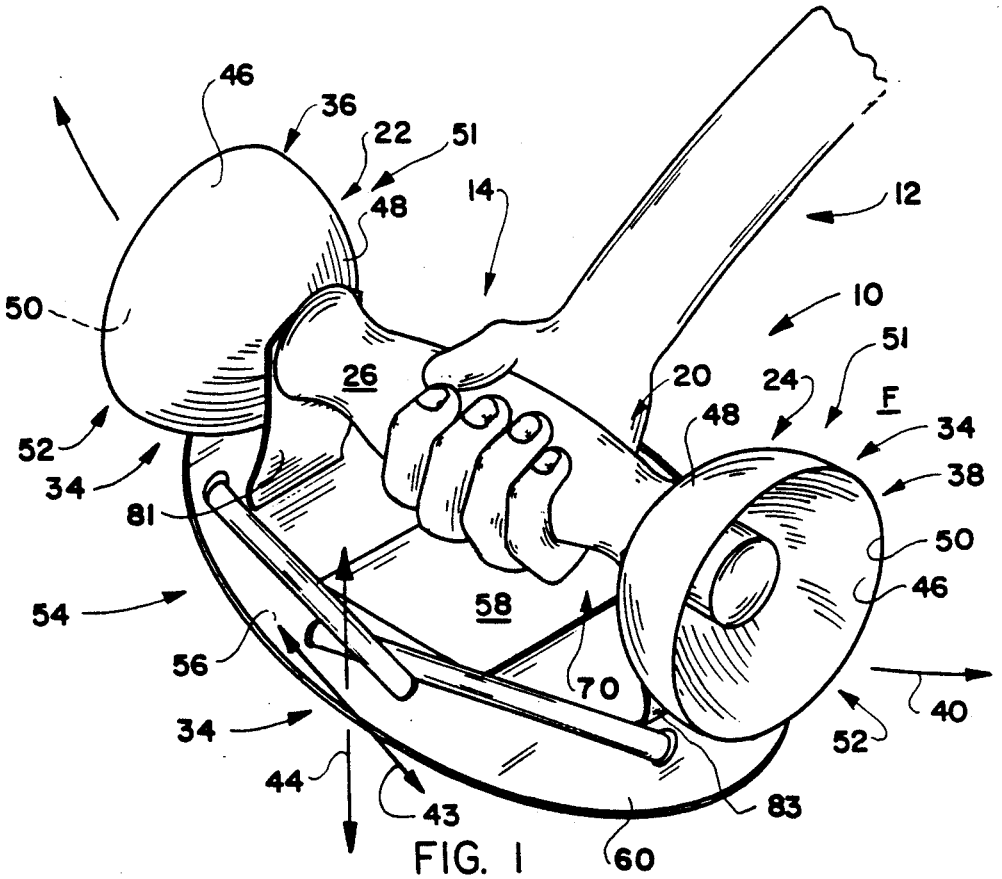
FIG. 1 is an isometric view of the aquatic apparatus removably attached to the hand of an aquatic exerciser.

FIG. 1 is an isometric view of the aquatic apparatus 10 of the invention removably attached to the hand 14 of an aquatic exerciser 12. The apparatus 10 which may be used by removably attaching the apparatus 10 to either the hand 14 or the foot 16 of an aquatic exerciser 12. The apparatus 10 includes a handgripping means 20 having a longitudinal dimension extending between a first end 22 and a second end 24. Preferably, the handgripping means is a shank-type handgrip 26 which conforms into the contour of the hand 14 of the exerciser 12. Positioned at the first end 22 of the handgripping means 20 is a first 36 fluid resistance means 34. Positioned at the second end 24 of the handgripping means 20 is a second 38 fluid resistance means 34. Preferably, each of the first 36 and second 38 fluid resistance means 34 are the same. The first 36 and second 38 fluid resistance means 34 each define a cup-shaped member 46. The closed end 48 of each of the cup-shaped member 46 is attached to the first end 22 and second end 24, respectively, of the handgripping means 20 and with the open end 50 of each cup-shaped member 46 extending outwardly from the first end and second end of the handgripping means, respectively. Thus, the concave surface 52 of each of the closed 48 cup-shaped member 46 faces outwardly from the handgripping means 20. The cup-shaped members 46 aid in maintaining the apparatus 10 in the intended plane of movement by being smoothly shaped 51 so as to not function as a "rudder" steering the apparatus away from the intended plane of movement of the exerciser. This advantage is especially beneficial when the apparatus is secured to the foot of an exerciser with weakened knees since lateral movement of the leg is lessened by the cup-shaped member. Preferably, each cup-shaped member is composed of a resilient material, such as resilient plastic.

Figure 3:
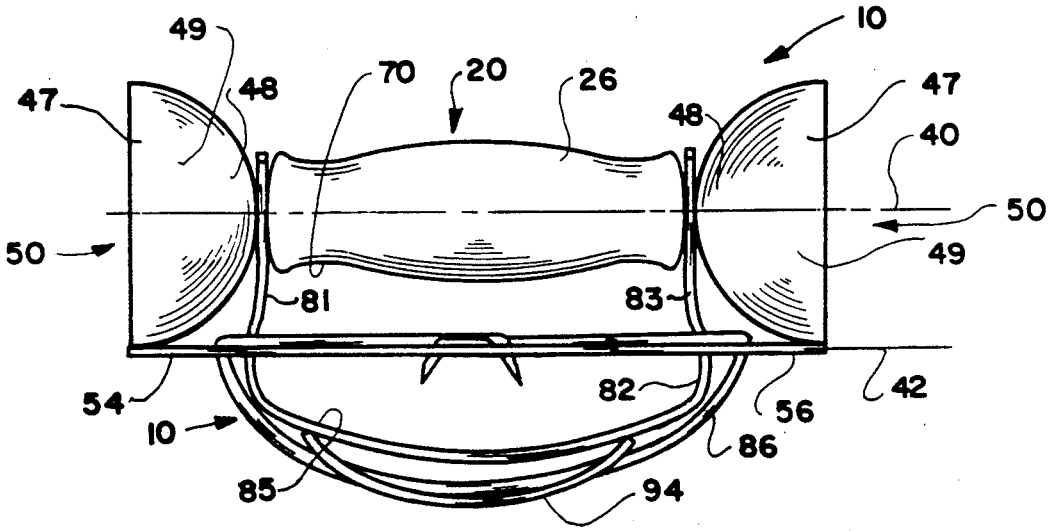
FIG. 3 is a side view of the aquatic exercise apparatus.

The apparatus 10 further includes a third 54 fluid resistance means 34. Preferably, the third 54 fluid resistance means 34 is a flat plate member 56 which extends in a plane parallel 42 to a first plane 40 extending through the longitudinal dimension of the handgripping means 20 as shown in FIG. 3. The third 54 fluid resistance means 34 is spaced apart from the hand gripping means 20 to form an opening 70. Opening 70 provides a space between the third fluid resistance means 54 and the handgripping means 20 for receiving in use a portion of the hand 14 of the exerciser 12. Preferably, the opening 70 includes a resilient pad 58 securely attached to the inner surface 60 of the flat plate member 56 to provide a frictional engagement when the hand of the user is positioned between the pad 58 and the handgripping means 20. Pad 58 enhances the securement of the apparatus 10 to the hand of the user during exercising.

Figure 2:
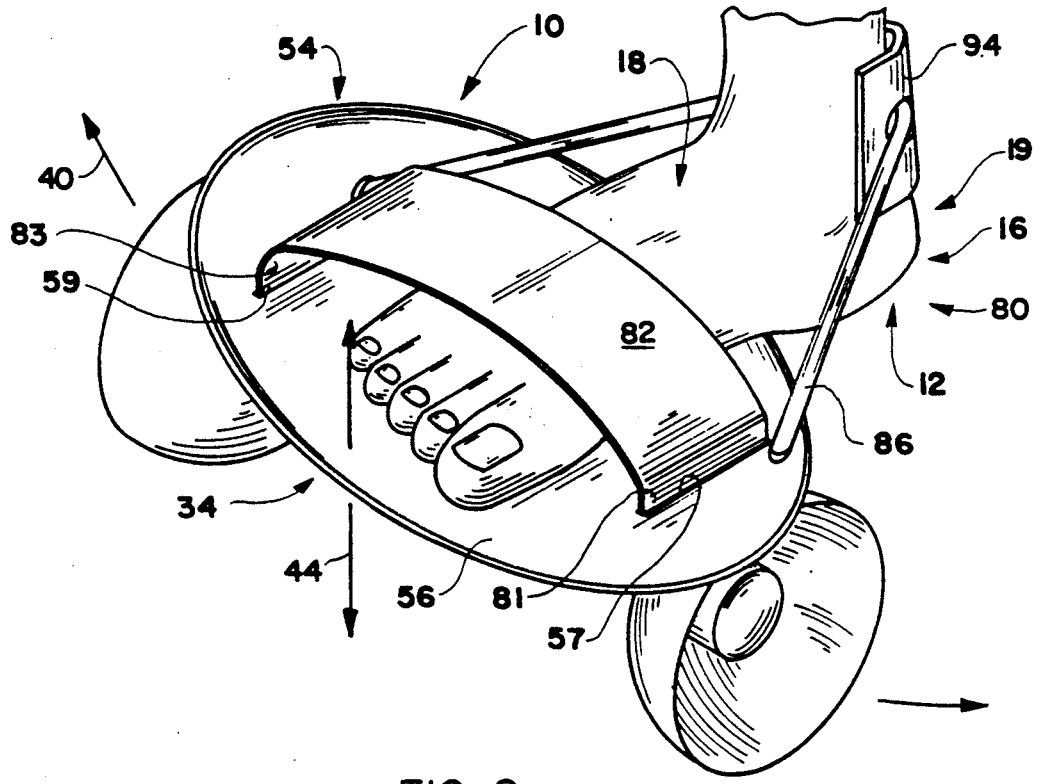
FIG. 2 is an isometric view of the aquatic apparatus removably attached to the foot of an aquatic exerciser.

FIG. 2 is an isometric view of the aquatic apparatus 10 removably secured to the foot 16 of an aquatic exerciser 12. A foot attachment means 80 enables the exercise apparatus to be attached to the foot 16 of the exerciser 12. Preferably, the foot attachment means 80 includes a strap member 82 which secures the top of the foot 18 of the exerciser 12 to the apparatus 10 and an ankle member 94 for securing the ankle 19 of the exerciser 12 to the apparatus 10. The ankle member 94 further includes an elastomeric band 86 to aid in the retaining of the apparatus 10 to the foot 16 of the exerciser 12. The foot strap member 82 includes a first end 81 and a second end 83. The third 54 fluid resistance means 34 is secured to the handgripping means 20, such as shank-type handgrip 26, by passing the ends 81 and 83 of strap member 82 through slits 57 and 59 formed in the flat plate member 56 and securing each end 81 and 83 of strap member 82 to the first 22 and second 24 ends, respectively, of the shank-type handgrip 26 as shown in FIG. 3. Preferably, cup-shaped members 46 are resilient 47 to provide gradually increasing resistance to the strap member 82, as the strap member 82 is being pulled or spaced apart from the flat plate member 56 to receive the foot 16 of the exerciser 12. Thus, when the foot 16 is inserted into a slot 85 formed between the flat plate member 56 and the foot strap member 82 the resiliency 47 of the cup-shaped members 46 tensions strap 82 to securely position the apparatus 10 on the foot 16 of the exerciser 12. Furthermore, during exercise the apparatus 10 tends to pull away from the limb it is secured to and the gradually increasing resistance provided to the strap member by the resilient 47 cup-shaped members 46 aids is keeping the apparatus 10 securely attached to the foot 16 of the exerciser.

FIG. 3 is a side view of the aquatic exercise apparatus 10 with resilient 47 cup members 46 engaging an inner surface 60 of flat plate member 54 as the strap member 82 is pulled away from flat plate member 54 to provide the slot 85 for the foot 16 of the aquatic exerciser 12. Cup-shaped members 46 slightly deform upon engaging the inner surface 60 of flat plate member 54 during the tensioning of strap member 82. After use, cup-shaped members 46 return to a pre-tensioned shape.

Figure 4:
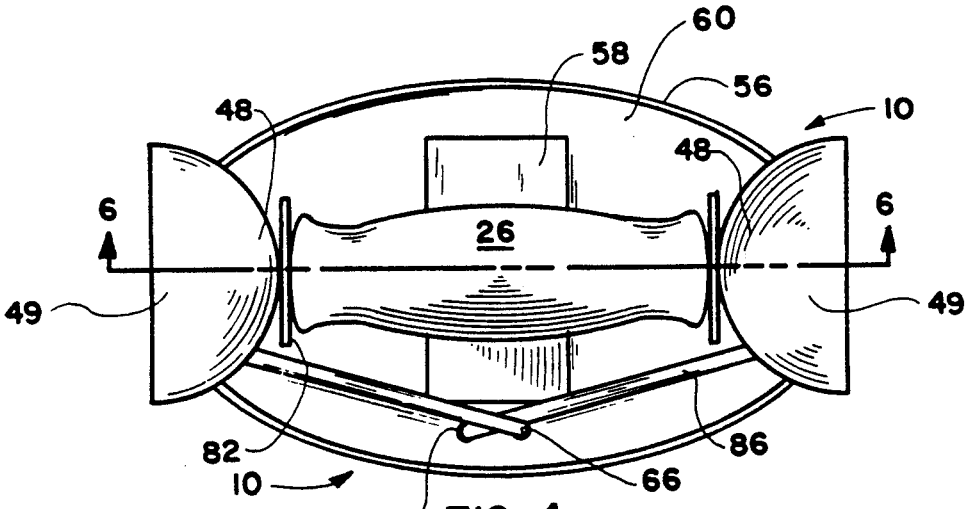
FIG. 4 is a top view of the aquatic exercise apparatus.
Figure 5:
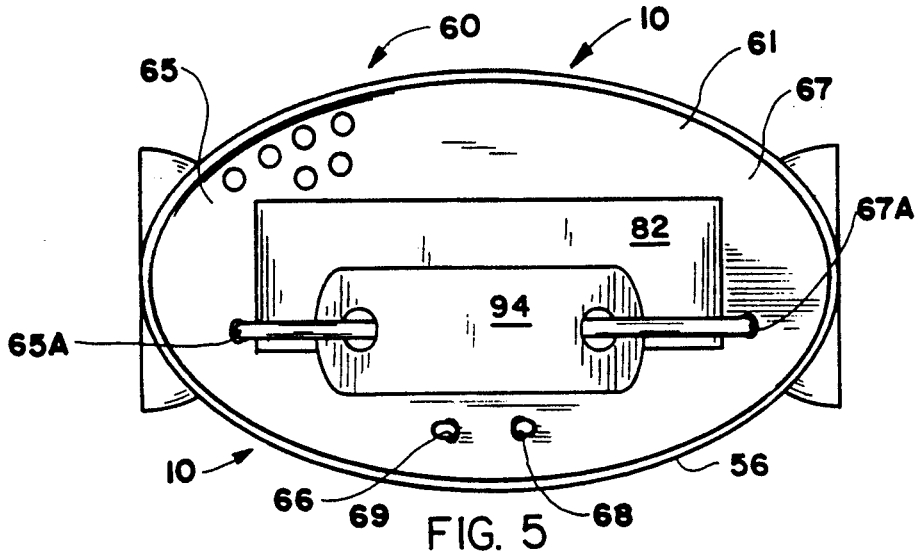
FIG. 5 is a bottom view of the aquatic exercise apparatus.

FIG. 4 is a top view of the aquatic exercise apparatus 10 with an elastomeric band 86 securing ankle member 94 to the flat plate member 56. The elastomeric band 86 aids in the retaining of the apparatus 10 to the foot 16 of the exerciser 12 by tensioning the ankle member 94 to the ankle 19 of the exerciser 12. Preferably, the flat plate member 56 includes a first 65A and a second hole 67A formed in the flat plate member, with each hole being spaced apart relative to one another and positioned in the first end 65 and second end 67 of the flat plate member 56, respectively, as shown in FIG. 5. A third hole 66 and a fourth hole 68 are formed in flat plate member 56 in the third end 69 of flat plate member 56. The elastomeric band 86 is threaded through the third hole 66, across the inner surface 60 of flat plate member 56 to and through the first hole 65A across an outer surface 61 of flat plate member 56 securing ankle member 94 to the band 86 and to and through second hole 67A and across the inner surface 60 and to and through fourth hole 68. The band 86 is secured to the flat plate member 56 at the third 66 and fourth 68 holes. This enables the length of the elastomeric band 86 extending between the first 65A and the second 67A holes to be adjusted by moving a desired length of band 86 through either or both of holes 65A and 67A to either lengthen or shorten the length of band 86 along the outer surface 61 of the flat plate member 56. Thus, the tension of band 86 may be adjusted to receive different sizes of feet.

FIG. 5 is a bottom view of the aquatic exercise apparatus. Preferably, the flat plate member 56 includes a plurality of apertures 64 (representative number illustrated) extending across the surface and through flat plate member 56 to permit the fluid "F" to flow through the plate member 56. Preferably, the plurality of apertures 64 extends evenly across the surface of the flat plate 56. The plurality of apertures 64 aid in stabilizing the apparatus as it is moved through a predetermined plane of movement by the exerciser. However, the apertures 64 decrease resistance to movement through the body of water "F".

Figure 6:
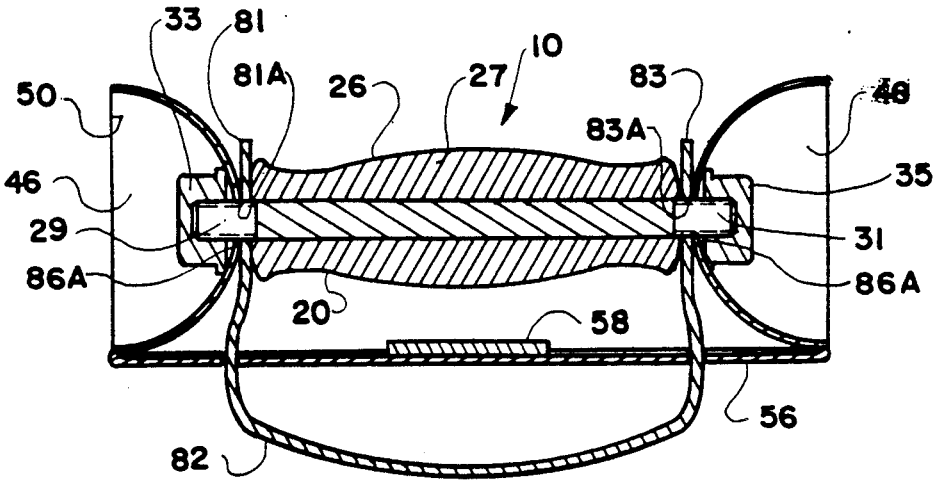
FIG. 6 is a sectional view of the aquatic exercise apparatus.

FIG. 6 is a sectional view along line 6—6 in FIG. 4 of the aquatic exercise apparatus 10. The handgripping means is preferably a shank-type handgrip 26 which is covered by a resilient tubular gripping pad 27 to further enhance the grip of the apparatus 10 by hand 14 of the exerciser 12. Formed in foot strap member 82 at the first end 81 and second end 83 are a first end-opening 81A and a second end-opening 83A, respectively. The first end 29 and the second end 31 of the shank-type handgrip 26 receive the first end-opening 81A and second end-opening 83A, respectively, of strap member 82 to secure the strap 82 to the apparatus 10. The strap member 82 serves to hold the flat plate member 56 to the apparatus. The strap member 82 also aids in receiving the foot 16 of the exerciser as discussed above. Preferably, the first end 29 and the second end 31 of the shank-type handgrip 26 are provided with screw threads in order to threadably receive the internal threads of caps 33 and 35.

Figure 7:
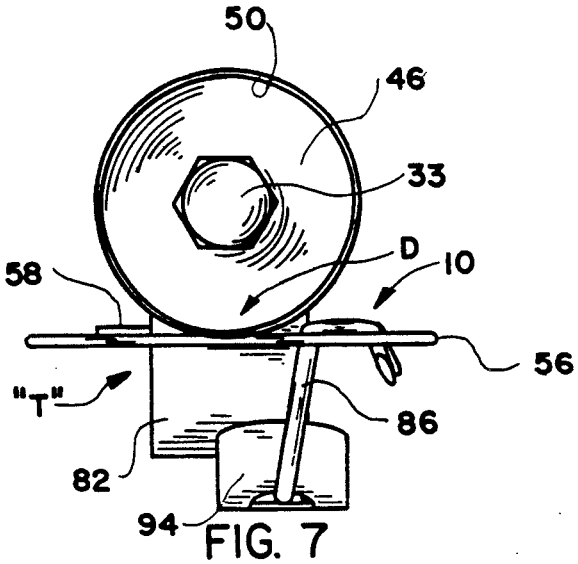
FIG. 7 is an end view of the aquatic exercise apparatus.

FIG. 7 is an end view of the aquatic exercise apparatus 10 illustrating cap 33 securing cup-shaped member 46 to the handgripping means. Resilient 47 cup-shaped member 46 is slightly deformed "D" because of the tensioning "T" of strap 82. Preferably, the closed end 48 of each cup-shaped member 46 is provided with a bottom aperture in order that caps 33 and 35 retain each cup-shaped member when caps are secured to the first end 29 and second end 31 of the handgrip 26, respectively.

The aquatic exercise apparatus 10 provides multidimensional resistance through all planes of movement by the arm/leg of the exerciser. Such planes of movement include the first plane of the handgripping means 40 and planes parallel thereto, such as plane 42, planes perpendicular to the plane of the handgripping means 40 and planes parallel thereto, such as a second plane 44 and the planes oblique to the aforementioned planes, such as plane 43.

Thus, when the apparatus 10 illustrated at FIG. 3 is moved by the exerciser in a plane perpendicular to the plane of the paper at FIG. 3, the side body 49 of the cup-shaped member 46 increases resistance to movement by the arm/leg of the exerciser.

Figure 8:
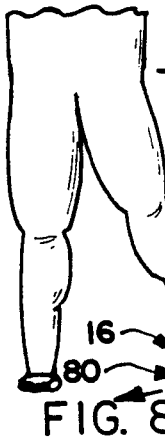
FIG. 8 is a front view of an exerciser utilizing the apparatus.

When the apparatus 10 illustrated at FIG. 3 is moved by the exerciser in the plane of the paper at FIG. 3, the open end 50 of cup-shaped member 46 increases resistance to movement by the arm/leg of the exerciser. This would also be the same for movement of the apparatus 10 in the plane of the paper as illustrated at FIGS. 4 and 5. For example, with the apparatus 10 secured to the foot of the exerciser undergoing a hip abduction-adduction exercise the cup-shaped members 46 would provide the increased resistance to movement of the leg of the exerciser, as illustrated at FIG. 8.

Figure 9:
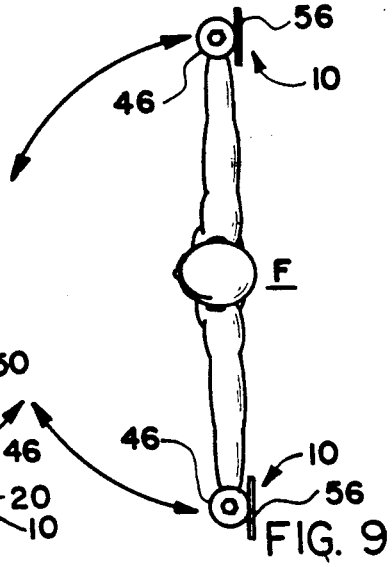
FIG. 9 is a top view of an exerciser utilizing the apparatus.

When the apparatus 10 illustrated at FIG. 4 is moved by the exerciser in a plane perpendicular to the plane of the paper at FIG. 4, the in a plane perpendicular to the plane of the paper at FIG. 4, the side body 49 of the cup-shaped member 46 together with the flat plate member 56 increase resistance to movement by the arm/leg of the exerciser. For example, utilizing an aquatic apparatus 10 secured to each hand and with a plate 56 of each apparatus 10 secured behind each back of each hand (see FIG. 1) of the exerciser, respectively, each arm outstretched in front of the exerciser at shoulder level with the back of the hand positioned vertically relative to the shoulders, then sweeping the arms from the front of the body to the side or back of the body and back to the front of the body, with the arms moving in a single plane and undergoing horizontal abduction-adduction exercise, the side body 49 of the cup-shaped member 46 together with the flat plate member 56 increases resistance to movement by the arm of the exerciser, as illustrated at FIG. 9.

When the apparatus 10 illustrated at FIG. 4 is moved by the exerciser in the plane of the paper at FIG. 4, the open end 50 of cup-shaped member 46 increases resistance to movement by the arm/leg of the exerciser.

Figure 10:
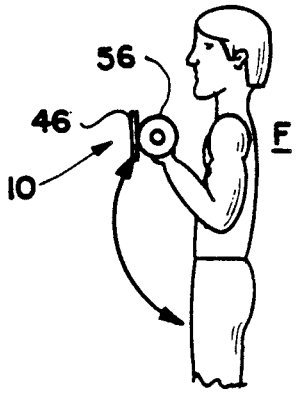
FIG. 10 is a side view of an exerciser utilizing the apparatus.

Another example, utilizing an aquatic apparatus 10 secured to each hand and with a plate 56 of each apparatus 10 secured behind each back of each hand (see FIG. 1) of the exerciser, respectively, each arm positioned at its respective side of the body of the exerciser with the hands supinated (palms of hands forward in an anatomic position) a biceps curl exercise is then initiated. The flat plate member 56 increases resistance to movement by the arm of the exerciser, as illustrated at FIG. 10.

During other exercises the apparatus 10 is moved planes which are oblique to the aforementioned planes and resistance to movement by the arm/leg of the exerciser results from the flat plate member 56 alone, from the cup-shaped members 46 or from the combination of the flat plate member 56 and the cup-shaped members 46.

Other exercises which use the apparatus of the invention 10 are within those skilled in the art to which this disclosure is directed.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An aquatic exercise apparatus for use by an exerciser in a body of water, comprising:

handgripping means for gripping the apparatus by the hand of the exerciser with said handgripping means having longitudinal dimension extending between a first end and a second end;

a first and a second fluid resistance means secured at said first end and said second end of said handgripping means, respectively, such that in use when said handgripping means is gripped by the hand of the exerciser and moved by the arm of the exerciser in a first plane extending through said longitudinal dimension of said handgripping means, resistance to such movement is increased;

a third fluid resistance means secured to said handgripping means in a plane parallel to said first plane to form an opening defined by said third fluid resistance means and said handgripping means for receiving in use a portion of the hand of the exerciser such that in use when said handgripping means is gripped by the hand of the exerciser and moved by the arm of the exerciser in a second plane perpendicular to said first plane resistance to such movement is increased;

a foot attachment means secured to said third fluid resistance means for detachably securing the apparatus to a foot of the exerciser such that in use upon movement of the apparatus by the leg of the exerciser in said second plane resistance to such movement is increased by said third fluid resistance means and movement of the apparatus by the leg of the exerciser in said first plane is resisted by said first and said second fluid resistance means such that resistance to such movement is increased; and said first and said second fluid resistance means each defining cup-shaped members including a closed end and open end with each said closed end being attached to the first end and second end, respectively, of said handgripping means such that said open end of each said cup-shaped member extends outwardly from the first end and second end of the handgripping means, respectively.

2. The aquatic exercise apparatus of claim 1 wherein said third fluid resistance means is a flat plate member which extends in a plane parallel to said handgripping means.

3. The aquatic exercise apparatus of claim 2 wherein said flat plate member includes a resilient pad to frictionally engage in use the hand of the exerciser such that the securement of the apparatus to the hand of the exerciser is enhanced.

4. An aquatic exercise apparatus for use by an exerciser in a body of water, comprising:

handgripping means for gripping the apparatus by the hand of the exerciser with said handgripping means having longitudinal dimension extending between a first end and a second end;

a first and a second fluid resistance means secured at said first end and said second end of said handgripping means, respectively, such that in use when said handgripping means is gripped by the hand of the exerciser and moved by the arm of the exerciser in a first plane extending through said longitudinal dimension of said handgripping means, resistance to such movement is increased;

a third fluid resistance means secured to said handgripping means in a plane parallel to said first plane to form an opening defined by said third fluid resistance means and said handgripping means for receiving in use a portion of the hand of the exerciser such that in use when said handgripping means is gripped by the hand of the exerciser and moved by the arm of the exerciser in a second plane perpendicular to said first plane resistance to such movement is increased;

a foot attachment means secured to said third fluid resistance means for detachably securing the apparatus to a foot of the exerciser such that in use upon movement of the apparatus by the leg of the exerciser in said second plane resistance to such movement is increased by said third fluid resistance means and movement of the apparatus by the leg of the exerciser in said first plane is resisted by said first and said second fluid resistance means such that resistance to such movement is increased; and said third resistance means being a flat plate member which extends in a plane parallel to said first plane and including a plurality of apertures extending therethrough to permit the fluid to flow through said flat plate member and to aid in the control of the apparatus when moved by the exerciser in said plane perpendicular to said handgripping means.

5. The aquatic exercise apparatus of claim 1 wherein said foot attachment means secured to said third fluid resistance means for detachably securing the apparatus to a foot of the exerciser includes a strap member for securing the top of the foot of the exerciser to the apparatus and an ankle member for securing the ankle of the exerciser to the apparatus.

6. An aquatic exercise apparatus for use by an exerciser in a body of water, comprising:

handgripping means for gripping the apparatus by the hand of the exerciser with said handgripping means having longitudinal dimension extending between a first end and a second end;

a first and a second fluid resistance means secured at said first end and said second end of said handgripping means, respectively, such that in use when said handgripping means is gripped by the hand of the exerciser and moved by the arm of the exerciser in a first plane extending through said longitudinal dimension of said handgripping means, resistance to such movement is increased;

a third fluid resistance means secured to said handgripping means in a plane parallel to said first plane to form an opening defined by said third fluid resistance means and said handgripping means for receiving in use a portion of the hand of the exerciser such that in use when said handgripping means is gripped by the hand of the exerciser and moved by the arm of the exerciser in a second plane perpendicular to said first plane resistance to such movement is increased;

a foot attachment means secured to said third fluid resistance means for detachably securing the apparatus to a foot of the exerciser such that in use upon movement of the apparatus by the leg of the exerciser in said second plane resistance to such movement is increased by said third fluid resistance means and movement of the apparatus by the leg of the exerciser in said first plane is resisted by said first and said second fluid resistance means such that resistance to such movement is increased; and said third fluid resistance means being a flat plate member which extends in a plane parallel to said first plane; and said first and said second fluid resistance means each defining resilient closed cup-shaped members such that in use when the foot of the exerciser is inserted into a slot formed between said flat plate member and said foot strap member, the cup-shaped members resistantly engage said flat plate member to provide a gradually increasing resistance to a continued spacing apart of said strap member relative to said flat plate member thereby increasingly tensioning said strap member against the top of the foot of the exerciser.

7. The aquatic exercise apparatus of claim 1 wherein said third fluid resistance means is a flat plate member which extends in a plane parallel to said handgripping means; and said foot attachment means secured to said flat plate member for detachably securing the apparatus to a foot of the exerciser includes a strap member for securing the top of the foot of the exerciser to the apparatus and an ankle member for securing the ankle of the exerciser to the apparatus.

8. An aquatic exercise apparatus for use by an exerciser in a body of water, comprising:

handgripping means for gripping the apparatus by the hand of the exerciser with said handgripping means having longitudinal dimension extending between a first end and a second end;

a first and a second fluid resistance means secured at said first end and said second end of said handgripping means, respectively, such that in use when said handgripping means is gripped by the hand of the exerciser and moved by the arm of the exerciser in a first plane extending through said longitudinal dimension of said handgripping means resistance to such movement is increased;

said first and second fluid resistance means secured at said first end and said second end of said handgripping means, respectively, each defining a cup shaped member;

a third fluid resistance means secured to said handgripping means in a plane parallel to said first plane to form an opening defined by said third fluid resistance means and said handgripping means for receiving in use a portion of the hand of the exerciser such that in use when said handgripping means is gripped by the hand of the exerciser and moved by the arm of the exerciser in a second plane perpendicular to said first plane resistance to such movement is increased;

said third fluid resistance means being a flat plate member which extends in a plane parallel to said first plane;

a foot attachment means secured to said flat plate member for detachably securing the apparatus to a foot of the exerciser such that in use upon movement of the apparatus by the leg of the exerciser in said second plane, resistance to such movement is increased by said flat plate member and movement of the apparatus by the leg of the exerciser in said first plane is resisted by said closed cup shaped members such that resistance to such movement is increased;

said foot attachment means includes a strap member for securing the top of the foot of the exerciser to the apparatus and an ankle member for securing the ankle of the exerciser to the apparatus; and said closed cup-shaped members being resilient such that in use when the foot of the exerciser is inserted into a slot formed between said flat plate member and said foot strap member, the cup-shaped members resistantly engage said flat plate member to provide a gradually increasing resistance to a continued spacing apart of said strap member relative to said flat plate member thereby increasingly tensioning said strap member against the top of the foot of the exerciser.

9. The aquatic exercise apparatus of claim 8 wherein said flat plate member includes a resilient pad to frictionally engage in use the hand of the exerciser such that the securement of the apparatus to the hand of the exerciser is enhanced.

10. The aquatic exercise apparatus of claim 8 wherein said flat plate member further includes a plurality of apertures extending therethrough to permit the fluid to flow through said flat plate member and to aid in the control of the apparatus when moved by the exerciser in said plane perpendicular to said handgripping means.

11. The aquatic exercise apparatus of claim 8 wherein each said cup-shaped members include a closed end and and open end with each said closed end being attached to the first end and second end, respectively, of said handgripping means such that said open end of each said cup-shaped member extends outwardly from the first end and second end of the handgripping means, respectively.

* * * * *